United States Patent [19]

Barlow et al.

[11] 4,147,355

[45] Apr. 3, 1979

[54] TARGET SHOOTING APPARATUS

[75] Inventors: Gordon A. Barlow, Evanston; Gunars Licitis, Lombard; John R. Wildman, Hanover Park, all of Ill.

[73] Assignee: Marvin Glass & Associates, Chicago, Ill.

[21] Appl. No.: 767,393

[22] Filed: Feb. 14, 1977

[51] Int. Cl.[2] ..... F41J 5/02

[52] U.S. Cl. ..... 273/101.1; 273/102.2 B; 46/175 R; 46/191

[58] Field of Search ..... 273/101.1, 102 AP, 102.1 R, 273/102.1 B, 102.1 C, 102.1 E, 102.1 D, 102.1 F, 102.2 B, 127 B; 46/175 R, 191, 177

[56] References Cited

U.S. PATENT DOCUMENTS

| | | | |
|---|---|---|---|
| 2,131,791 | 10/1938 | Carter | 273/101.1 |
| 2,254,952 | 9/1941 | Squire | 273/101.1 |
| 2,269,258 | 1/1942 | Falkenberg | 273/101.1 |
| 2,308,814 | 1/1943 | Kenny et al. | 273/101.1 |
| 2,309,614 | 1/1943 | Jensen | 273/101.1 |
| 2,486,860 | 11/1949 | Memmel | 273/102.1 F |
| 3,220,732 | 11/1965 | Pincus | 46/175 R |
| 3,621,606 | 11/1971 | Potrzuski | 46/175 R |
| 3,891,216 | 6/1975 | Ensmann et al. | 273/102.1 C |

FOREIGN PATENT DOCUMENTS

| | | | |
|---|---|---|---|
| 883984 | 12/1961 | United Kingdom | 46/175 R |

*Primary Examiner*—Robert W. Michell
*Assistant Examiner*—Arthur S. Rose
*Attorney, Agent, or Firm*—Mason, Kolehmainen, Rathburn & Wyss

[57] ABSTRACT

A target shooting apparatus including an operator controlled simulated gun which projects a light beam of short duration toward a target each time the trigger is actuated. A simulated gun may be cocked between each "shot" which resets a recoiling, sounding mechanism to give a true life operational effect to the gun. The target includes a frame which rotatably mounts a pair of tables, each carrying a plurality of target devices. Additionally, a slidably mounted subframe assembly mounts at least one additional target for reciprocal, side-to-side motion. A target impeller mechanism is provided on the frame in proximity to each of the rotatable tables and the reciprocal subframe so that, when actuated, the impeller will cause rotational movement of the associated target indicating a "hit". The target impellers are actuated by a control mechanism as the proper alignment of the light beam from the gun with one of a plurality of phototransistors is sensed. The control mechanism includes a single solenoid for actuating at least one of the targets each time any one of the phototransistors receives a predetermined amount of light. The apparatus includes a plurality of lights and a sounding mechanism which are actuated for a predetermined period of time after a "hit". A drive mechanism maintains all of the target devices in constant motion for a specific period of time, which is controlled by a timing cam. A scoring device maintains a running score associated with the number of targets "hit".

22 Claims, 12 Drawing Figures

TARGET SHOOTING APPARATUS

BACKGROUND OF THE INVENTION

1. Field of the Invention

This invention relates to target shooting galleries and particularly to a target shooting apparatus which causes various target devices to be pivoted relative to the frame upon timed actuation of a simulated gun.

2. Brief Description of the Prior Art

Target shooting amusement devices for testing marksmanship or other skills in which an image or target is projected onto a screen, are well known. Heretofore, such devices, for the most part, merely had indicated when a simulated shooting or other aiming device was properly aligned with the actual or projected image. Such alignment was indicated by flashing lights, hit and miss scoring mechanisms, or similar visual or audio means. In other marksmanship devices, a mechanism was utilized in connection with a moving target, wherein the timing of the position of the image with the coincidence of the simulated projectile was accomplished by utilizing a large number of electrical contacts or the like. Some devices have used a phototransistor which was actuated upon proper aiming of a light source. However, these devices generally use expensive targets which include the photocell therein for sensing the simulated hit. The present invention provides a novel electronic target shooting device enabling optimum play at a substantially reduced cost.

SUMMARY OF THE INVENTION

The present invention provides a target shooting apparatus including an operator controlled aiming device which projects a light beam of short duration toward a target each time the trigger is actuated. An aiming device may be cocked between each "shot" which resets a recoiling, sounding mechanism to give a true life operational effect. The target includes a frame which rotatably mounts a pair of platens, each carrying a plurality of pivotally mounted target devices. Additionally, a movably mounted subframe assembly mounts at least one additional target for reciprocal motion. A target impeller means is provided on the frame in proximity to each of the rotatable tables and the reciprocal subframe so that, when actuated, the impeller will cause rotational movement of the associated target indicating a "hit". The target impellers are actuated by a control means as a phototransistor therein senses the proper alignment of the light beam with one of a plurality of phototransistors. The control means includes a single solenoid for actuating at least one of the targets each time any one of the phototransistors receives a predetermined amount of light. The apparatus includes a plurality of lights and sounding means which are actuated for a predetermined period of time after a "hit". A drive mechanism maintains all of the target devices in constant motion for a specific period of time, which is controlled by a timing cam, and a scoring device maintains a running score associated with the number of targets "hit".

DESCRIPTION OF THE PREFERRED EMBODIMENT

Figure 1:
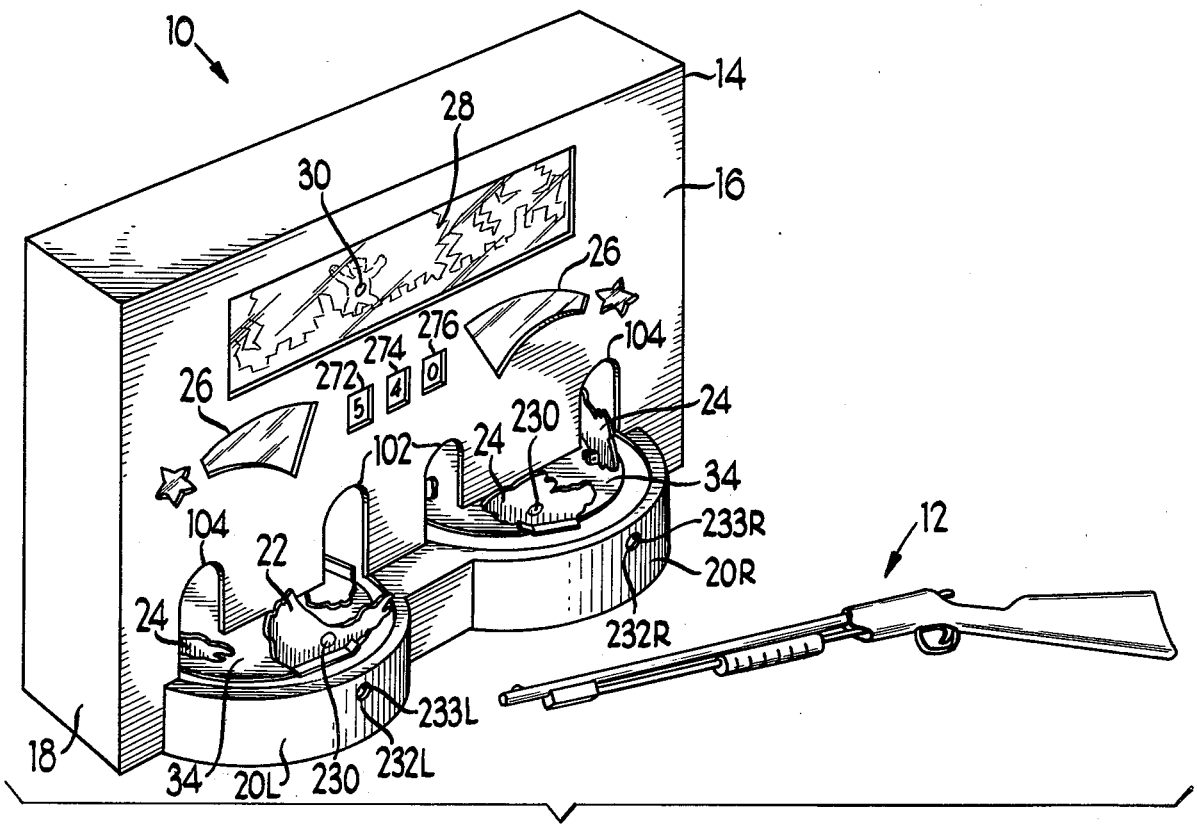
FIG. 1 is a perspective view of a target shooting apparatus embodying the concepts of the present invention.

A target shooting apparatus made in accordance with the concepts of the present invention is shown in a perspective view, generally designated 10 (FIG. 1). The target shooting apparatus includes a simulated aiming device or gun 12 for use with the apparatus 10 as will be described in greater detail hereinafter. The apparatus includes a generally rectangular housing 14 having a front 16, back and side walls 18 to enclose certain moving elements of the apparatus. A pair of generally semicircular, forwardly extending molded base members 20L and 20R support moving targets 22 and 24. The front wall 16 includes a pair of arcuate flaired windows 26 and a top generally transversely extending window 28. A reciprocally moving target 30 is visible through the window 28.

Figure 4:
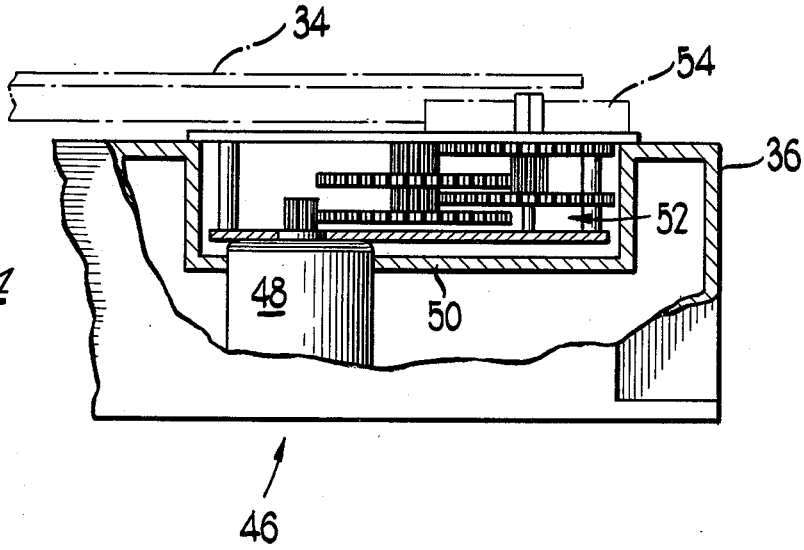
FIG. 4 is a vertical section of the drive motor and gear train, on an enlarged scale, taken generally along line 4—4 of FIG. 3.
Figure 2:
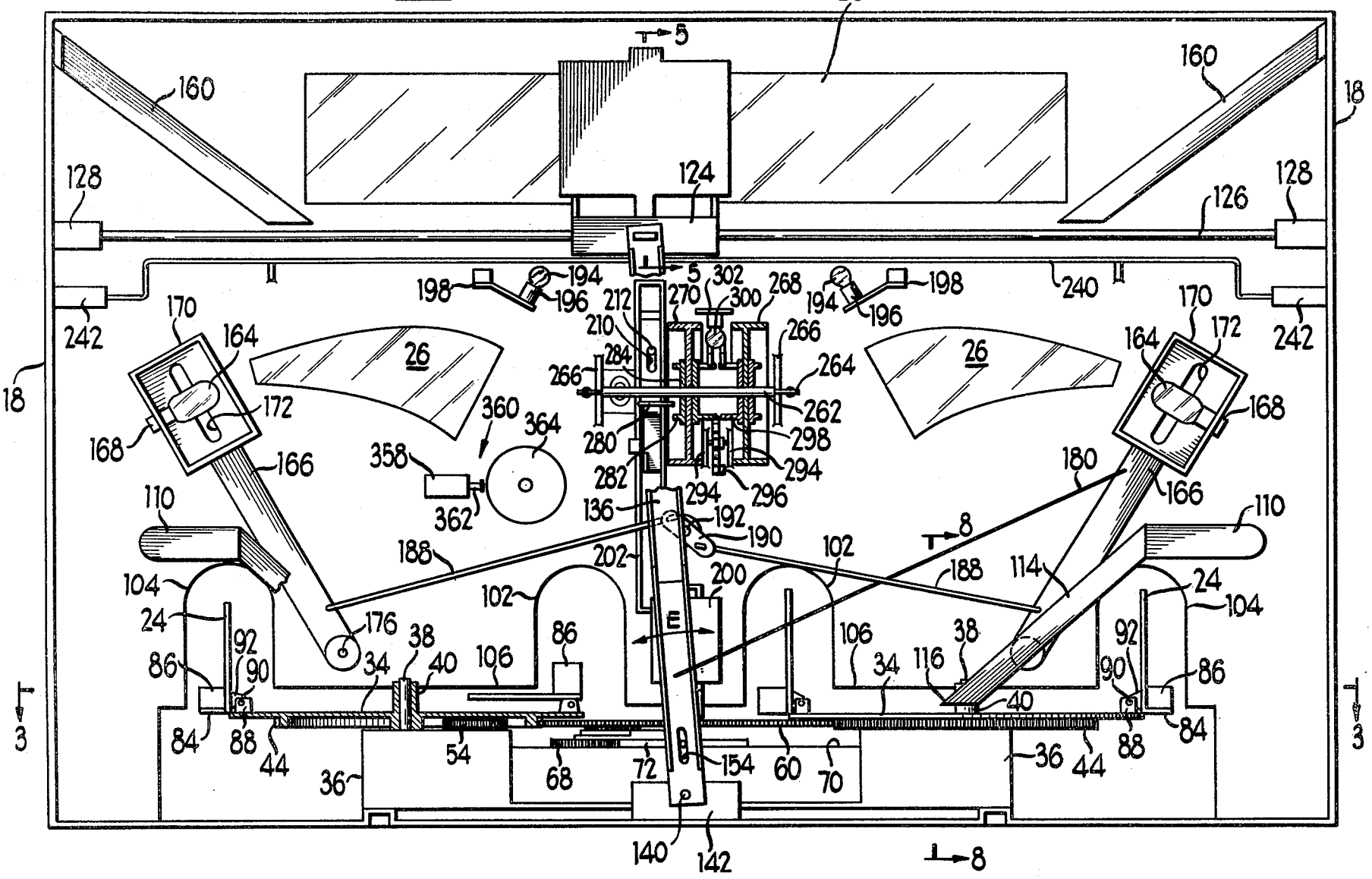
FIG. 2 is a rear, elevational view, on an enlarged scale, of the back of the target shooting apparatus with the rear wall removed.
Figure 3:
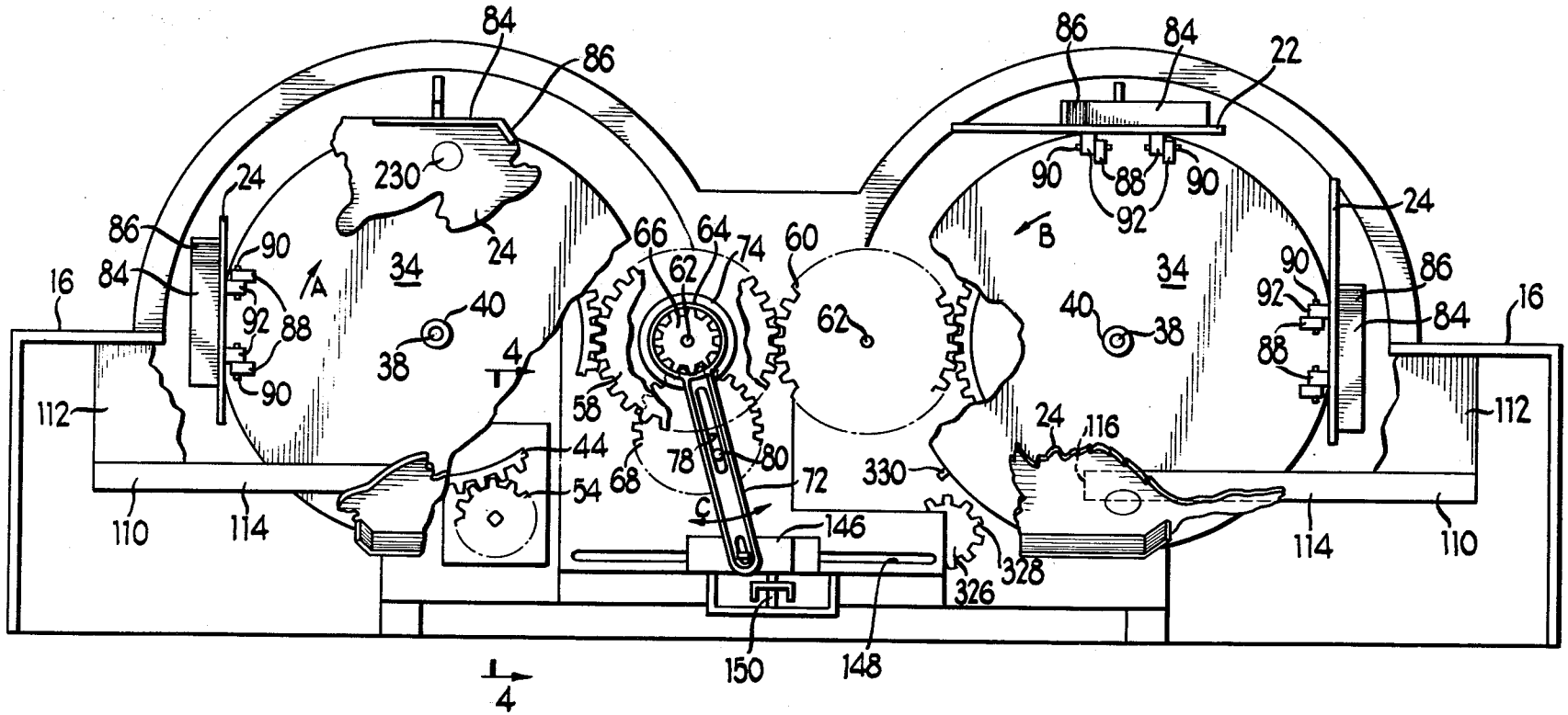
FIG. 3 is a horizontal section of the target shooting apparatus taken generally along line 3—3 of FIG. 2.

Referring to FIGS. 2–4, a pair of rotatable platens 34 are mounted on the base for rotation about a central vertical axis generally at the center of the protruding circular base portions 20L and 20R. Each of the platens 34 is mounted to a raised, molded platform 36 by an axle 38 and freely rotatable on the axle by integrally molded journals 40. A ring gear 44 is provided, and preferably integrally molded to the bottom of each platen 34 for driving engagement with a drive means, generally designated 46 (FIG. 4). The drive means 46 includes a motor 48 mounted within a subframe 50 below the platform 36 on the lefthand side as shown in FIG. 2. A reduction gear train 52 transmits the rotary motion to an output gear 54 (FIGS. 3 and 4) on the top of the platform 36. The output gear 54 meshes with the ring gear 44 formed on the rotary platen 34 shown in the left of FIG. 2. Thus, as the motor 48 is energized, the left platen is driven directly. The driven platen 34, referring to FIG. 3, has its ring gear in meshing engagement with a first idler gear 58 in mesh with a second idler gear 60 both of which are rotatably mounted by vertical shafts 62 on the frame. The second idler gear 60 meshes with the ring gear 44 on the bottom of the platen 34 shown in the right of FIGS. 2 and 3. Thus, the platforms rotate in opposite directions such that, when driven by the motor 48, the left platen rotates in the direction of arrow A while the right platen rotates in the direction of arrow B as shown in FIG. 3.

The first idler gear 58 includes, on its bottom side, a raised circular journal bearing surface 64 and, below that, an integrally molded pinion gear 66. The pinion gear 66 meshes with an output crank gear 68 rotatably mounted on a horizontal surface 70 within the frame. A crank arm 72 includes a large journal 74 fitted about the journal bearing 64 to provide a pivot axis about the shaft 62 for the crank arm 72. The crank arm 72 includes a generally longitudinal slot 78 which slidably engages a vertical pin 80 secured to the crank gear 68 so that, as the crank gear 68 is rotated by the pinion gear 66, the crank arm 72 will be pivoted back and forth in the directions of arrow C as shown in FIG. 3. This pivotal movement of the crank arm drives the reciprocal target 30 at the top of the housing 14 as will be described in detail hereinafter.

Each of the rotatable platens 34 carries four animal-shaped target devices such as the duck 22, or rabbit 24. The animal shape is formed of flat sheet material and is generally vertically aligned prior to a "hit". The vertical plates each include a generally horizontal flange or leg portion 84 having an upwardly inclined guide surface 86 in its direction of travel. Hinge means including a pair of journals 88 are secured by pins 90 to a similar pair of journals 92 secured to the rear surface of the target. Thus, the targets 22 and 24 are pivotal between a generally vertical position as shown in the right of FIGS. 2 and 3 designated as the "preset" position, to a knocked-down horizontal position as shown generally in the left of FIGS. 2 and 3, defining the "hit" position. The targets 22 and 24 are moved between the "preset" position to the "hit" position in response to actuation of a target impeller means, generally designated 100 in FIG. 7, to be described in greater detail hereinafter.

The target impeller means is operable to "hit" a target only when the target 22 or 24 is directly at the front of the semi-circular protrusion 20L or 20R. In the preferred embodiment, the two rotatable platens 34 are prealigned in an out-of-phase relationship of approximately 45° so that a target on either one of the rotatable platens is directed generally forwardly on only one of the platens at a time. For clearness and understanding of the invention, FIGS. 2 and 3 have been drawn to show other features of the present invention, and therefore have been shown to be in phase, however, the preferred embodiment is designed for use with the targets out-of-phase as shown in FIG. 1, described above. As the platens rotate, the targets will move inwardly, through arches 102 in the front wall 16 and outwardly through arches 104 in the front wall. If one of the targets has been hit, the target portion will lie in a substantially horizontal plane so as to pass under a bottom edge 106 of the front wall between the two arches 102 and 104.

A pair of target reset arms 110 are mounted on flanges 112 on the back of the front wall 16. The arms 110 each include a downwardly canted cam portion 114 which extends downwardly to a point 116 generally past the center of the rotatable platens, near the rear periphery thereof. If a target has been hit, and knocked down, as shown in the left of FIGS. 2 and 3, as the target 24 approaches the cam portion 114, it will pass over the top surface thereof and be automatically reset to its preset position and then pass under the top 110 of the arm and outwardly through the arch 104 for additional play. If a target has not been hit, it will merely pass behind the cam portions 114 for continued rotation.

Figure 5:
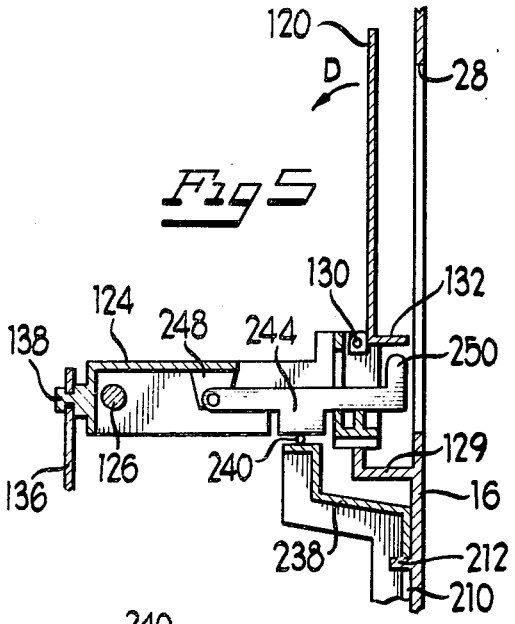
FIG. 5 is a side elevational view of the reciprocal target element taken generally along line 5—5 of FIG. 2.
Figure 6:
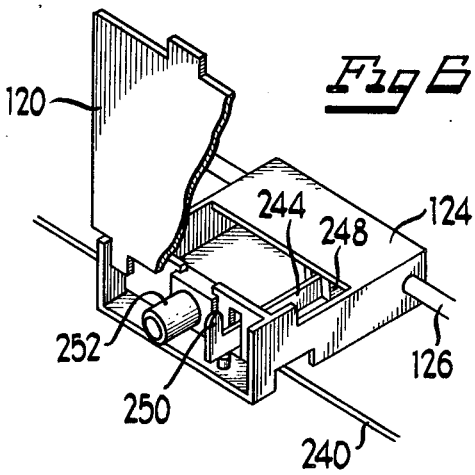
FIG. 6 is a partially fragmented, perspective view of the reciprocal target of FIG. 5.

Referring to FIGS. 2, 5 and 6, the upper target 30 is provided on the front of a generally vertical, rectangular plate 120 which provides an upper, reciprocating target. The upper target 30 and plate 120 are mounted by a generally rectangular carriage 124 behind the top window 28. The rear of the carriage is mounted for right to left reciprocating movement by a guide rod 126 mounted within a pair of supports 128 secured to the side walls 18 of the housing. The front end of the carriage is slidably mounted by a generally L-shaped extending arm 129 on the front wall 16 of the housing. The target 120 is similarly pivotally mounted by a hinge 130 and includes a generally horizontal flange or leg 132 for engagement by the target impeller means 100 so that the target can be moved from a "preset" or vertical position as shown in FIGS. 5 and 6 to a generally knocked-down position pivoted approximately 90° in the direction of arrow D in FIG. 5.

The carriage 124 is caused to reciprocate by a connecting link 136 shown fragmented in FIG. 2. The connecting link 136 is pivotally mounted by a pin 138 at its top to the carriage, and by a similar pivot pin 140 at its bottom secured to a mounting plate 142. The connecting link 136 includes two portions which telescope so that, as a link 136 is driven in its arcuate path as shown by arrows E, it will drive the carriage 124 and upper target reciprocally in front of the window 28.

The crank arm 72 is pivotally connected to a guide member 146 which is slidably mounted within a slot 148 formed on the surface 70. The guide member 146 includes a rearwardly extending pin 150 which passes through an elongated slot 154 in the connecting link 136 so that, as the crank arm is pivoted back and forth in the direction of arrow C by the crank gear 68, the link 136 will be pivoted in a direction as shown by arrow E to drive the upper target carriage 124 along the guides 126 and 129.

The guide rod 126 extends substantially past each side of the window 28 for resetting the target 30. If a hit is scored, the target is knocked to its generally horizontal position, and is reset at the end of travel on either side of the window 28. The reset means includes a pair of generally dowardly canted cam arms 160 which operate in a similar manner as the arms 114 to lift and reset the target to its vertical position. The arms 160 are secured to the side walls 18, generally in back of the path of travel of the target, to properly lift and reset the target.

In addition to the movement of the targets, a pair of hit indicating lights 164 are mounted to a pair of continuously moving pivotally mounted light support arms 166. The lights 164 are mounted by suitable sockets 168 within rectangular frames 170 mounted on the ends of the arms 166. Each frame 170 includes a vertical slot 172 generally in front of the light which permits light to pass therethrough and through the arcuate windows 26 as the lights are moved. The arms 166 are each mounted by a pin 176 on the front wall 16 for pivotal movement toward and away from one another. A connecting shaft 180 is secured between the link 136 and the righthand arm 166 as shown in FIG. 2. Thus, as the link 136 reciprocates, the connecting rod 180 will pivot the righthand arm. Another pair of connecting rods 188 are pivotally secured between the two arms 166 and a bell crank 190 pivotally mounted generally at the center of the front wall 16 by an axial 192. Thus, as the righthand arm 166 is driven, the connecting rods 188 through the bell crank 190 will drive the lefthand arm 166 in a similar path of travel. In addition to the hit indicating lights 164, an additional pair of stationary hit indicating lights 194 are mounted by suitable sockets 196 and brackets 198 to the frame, generally below the window 28. As will be described in detail with respect to FIG. 9 hereinafter, the lights are lit for approximately a five second interval after a hit is registered.

Referring to FIGS. 5–8, and to FIG. 2, the target impeller means 100 is shown to include a single solenoid 200 for actuation of any of the targets. More particularly, the solenoid 200 is mounted by a flange generally rearwardly of the front wall as shown in FIG. 2 with its armature secured to a target impeller actuator 202. The target impeller actuator 202 is a generally vertically oriented multi-operational shaft having a generally channel-shaped top portion 204 and an L-shaped bottom portion 206. A pair of slots 210 in the shaft 202 slidably mount the shaft on a pair of pins 212 formed on the front wall, only one of which is shown in FIG. 2. The pins 212 and slots 210 permit the shaft to move upwardly, the length of the slot, when the solenoid is energized and, permit the shaft 202 to drop under the influence of gravity when the solenoid becomes de-energized.

Figure 8:
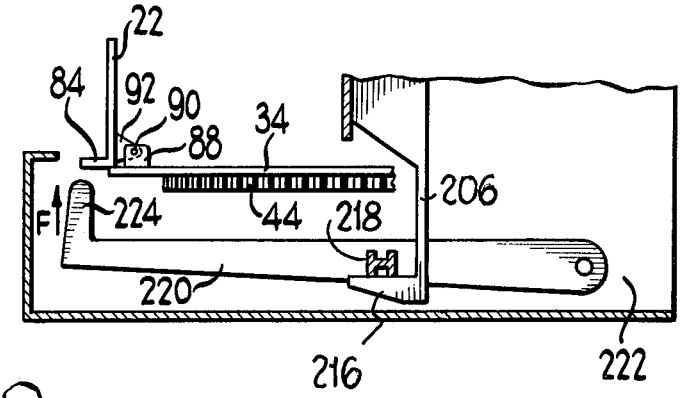
FIG. 8 is a vertical section of one of the target impellers taken generally along line 8—8 of FIG. 2.

The lower, generally L-shaped bottom end 206 of the shaft 202 includes a leg member 216 which extends generally rearwardly as shown in FIG. 8. The leg engages a horizontally disposed I-beam 218 which is secured at its opposite ends to a pair of pivotally mounted target impeller arms 220. Each target impeller arm 220 is pivotally mounted within a flange 222 in the housing and includes an upwardly directed target impeller 224 at its front end as shown to the left in FIG. 8. The target impeller 224 travels in an arcuate path, in the direction of arrow F, as shown in FIG. 8, upon energization of the solenoid 200 for engagement with a flange 84 on one of the rotating targets 22 or 24. Thus, if the solenoid 200 is energized as a target 22 passes directly over the target impeller 224, the target 22 will be "hit" and moved to its generally horizontal position. As pointed out previously, the hinge mountings of the targets 22 and 24 are mounted near the periphery of the rotatable platens, so that the flanges 84 extend over the periphery for engagement by the target impeller.

As described above, a target impeller mounting arm 202 extends generally forwardly beneath each of the rotatable platens 34 so that targets can be "hit" on either side of the apparatus. However, as discussed previously with respect to FIG. 1, the platens 34 are preferably arranged so as to be out-of-phase by approximately 45° so that, at any instant, only one of the targets 22 or 24 on one of the platens 34 will be in a position for actuation by the target impellers 224. Both of the target impellers 224 are actuated by energization of the solenoid 200 and therefore, only one of the targets will be "hit". Each target 22, 24 and 30 includes a circular marking 230 generally at the center thereof at which, the operator, aims the simulated gun 12 as will be described hereinafter. Directly below the front top surface of each of the arcuate protrusions 20L and 20R, an aperture 232L or 232R is provided, behind which a photodetector 233L or 233R is mounted. The photodetector, as will be described with respect to FIG. 9, actuates the solenoid 200 when a predetermined amount of light impinges the photodetector for actuation of the targets. Therefore, for example, in FIG. 1, if the gun 12 were properly aimed at the duck 22 on the lefthand side, a predetermined amount of light would be emitted and pass through the aperture 232L to cause the duck 22 to be "hit". It should be pointed out, however, that any of the photodetectors will actuate the solenoid 200 and thus, an inadvertent aiming of the gun 212 toward the aperture 232R will cause the solenoid 200 to be energized and cause the duck 22 which has not been aimed at, to be "hit".

Figure 7:
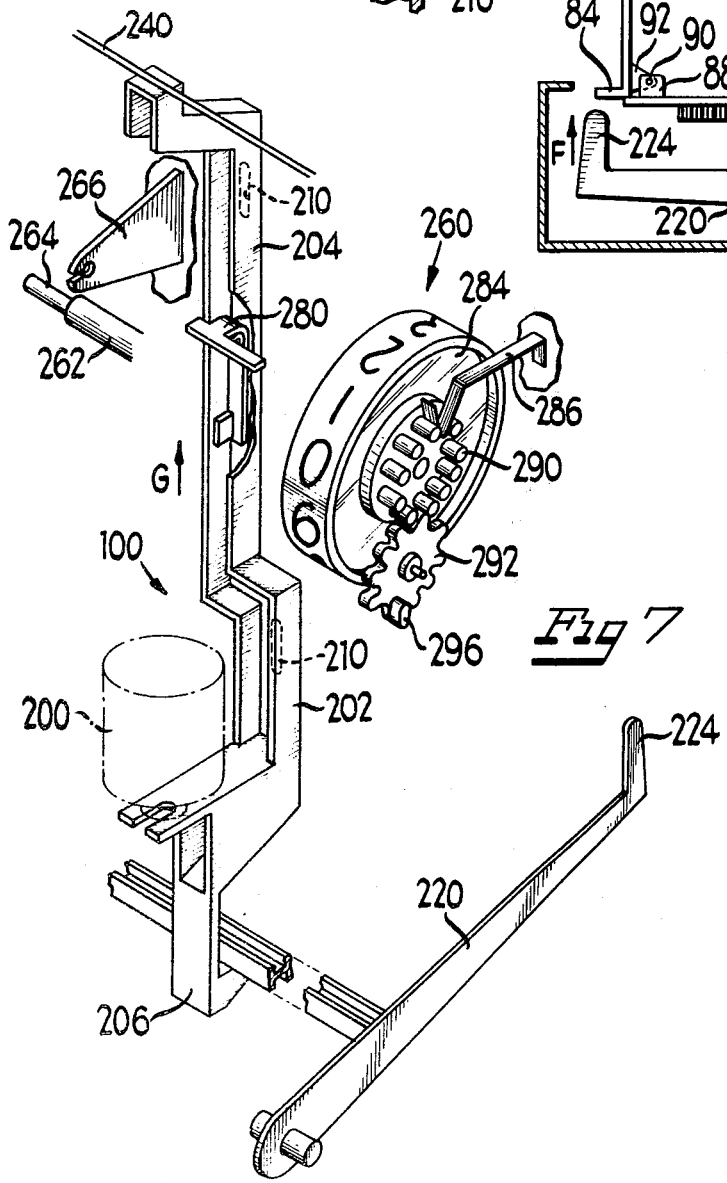
FIG. 7 is another partially fragmented, perspective view of the target impeller means and scoring device.

Referring to FIGS. 5 and 7, the upper channel-shaped end 204 of the target impeller actuator 202 extends upwardly below the path of travel of the carriage 124. A rearwardly offset section 238 extends beneath a generally taut wire 240 mounted within braces 242 at opposite ends of the frame. The wire 240 is thus positioned directly below a third target impeller mounting arm 244 which is pivotally mounted by a hinge 248 within the carriage 124. The target impeller mounting arm 244 carries a generally vertically directed target impeller 250 directly below the horizontal flange 132 of the target 30. As the solenoid 200 is actuated, the target impeller actuator moves upwardly generally in the direction of arrow G (FIG. 7) striking the wire 240 which transmits the motion to the target impeller mounting arm 244 and thus the target impeller 250 to "hit" the upper target 30. A third photodetector 252 is mounted within the carriage 124 directly below the target 30 for actuation of the solenoid 200 whenever a predetermined amount of light impinges the photodetector 252. The photodetector 252 always moves with the target 30 in a position to receive light from the simulated gun 12 through the window 28 for actuation of the solenoid 200. It should be pointed out therefore that actuation of the solenoid 200 by proper aiming toward the upper photodetector 252 may cause a hit to additionally be registered by knocking over one of the targets 22 or 24 if they are directly above one of the target impellers 224. Additionally, each time one of the photodetectors 233L or 233R is actuated by proper alignment of the simulated gun 12, the upper target 30 is always moved to its "hit" position. However, this is not distracting to the operator since he is generally looking at the target to which he had been aiming. The use of common components for the actuation of the targets provides a substantial savings in manufacture and simplicity of the device.

In addition to actuating the target impellers, the actuator 202 operates a scoring device generally designated 260. The scoring device 260 includes a generally horizontal shaft 262 mounted by its reduced ends 264 within a pair of rearwardly directed snap flanges 266. The shaft 262 rotatably mounts a pair of numbered drums 268 and 270. The drums 268 and 270 align respectively with a pair of rectangular apertures 272 and 274 formed in the front wall 16. A dummy, third rectangular opening 276 indicates an additional zero to add a digit to the score.

The actuator 202 carries a transversely extending tab 280 (FIGS. 2 and 7) which sequentially engages gear teeth 282 formed on the web 284 of the drum 270. Thus, each time the solenoid is energized, the tab 280 increments the tens digit wheel 270 one number. A leaf spring 286 contacts a plurality of studs 290 on the opposite side of the web 284 to positively maintain the drum for movement in 36° increments. The studs 290 drive an idler gear 292 which is rotatably mounted by a pair of flanges 294 between the drums 268 and 270. The idler gear 292 includes a tenth tooth 296 which engages a similar set of studs 298 on the drum 268 to increment the hundredth drum one digit after every revolution of the tenth drum. Therefore, each time the solenoid is actuated, a continuous count is maintained representing ten times the total number of "hits". In addition, a score illuminator 300 is mounted by a base 302 to illuminate the score whenever the target game is energized.

Figure 9:
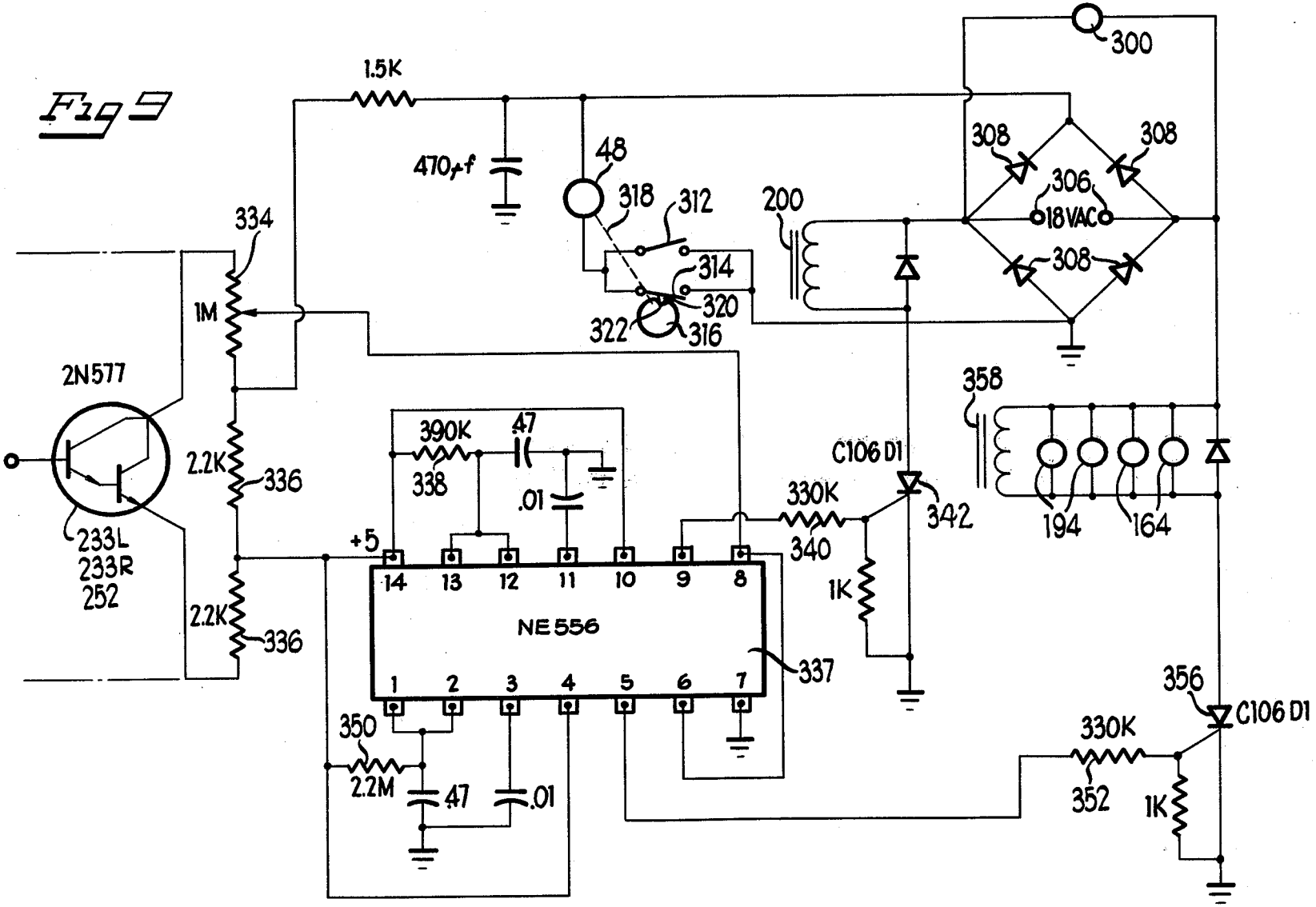
FIG. 9 is an electrical schematic drawing showing the circuitry of the target shooting apparatus of the present invention.

The operation of the target shooting apparatus 10 can best be understood with reference to the electrical schematic of FIG. 9. The preferred embodiment of the apparatus is powered at terminals 306 by an 18v AC source which is rectified by diodes 308. The DC output is applied to the motor 48 for driving the rotatable platens, the upper target carriage 124, and the movable light mounting arms 166. The motor is connected by a pair of parallel connected switches 312 and 314. The switch 312 is a manually actuated jog switch and energizes the motor whenever it is manually depressed. The switch 314 is a timer switch connected to a cam 316 driven by the motor as represented by the dotted line 318. The cam rides against a cam follower 320 on the switch 314 and maintains the switch 314 in a closed condition until the generally V-shaped notch 322 permits the cam follower 320 to open the switch. Thus, to start the apparatus, the jog switch 312 is manually closed until the switch 314 is closed by the cam. The apparatus will continue to operate until the cam 316 permits the switch 314 to open.

The cam is driven by a timing gear 326 (FIG. 3) which includes a plurality of teeth 328 around its periphery. At least one radially extending tab 330 is mounted on the righthand rotatable platen 34 as shown in FIG. 3 for engagement with the timing gear 326 to increment the timing gear one tooth for every revolution of the platen 34. Thus, if the timing gear were provided with twenty teeth 328, twenty revolutions of the platen 34 would rotate the timing gear 326 one revolution. At the end of one revolution, the switch 314 is automatically open to signal the end of play of the game.

The DC power is similarly applied to the three photodetectors which are connected in parallel. In the particular embodiment, the photodetectors 233L, 233R and 252 are photo-Darlington type phototransistors such as a 2N5777. The DC voltage is applied through a variable one megaohm resistor 334 which permits relative adjustment of the sensitivity of the phototransistors for operation of the game in rooms having various lighting conditions. A voltage divider network including two 2.2k resistors 336 provides approximately a 5v VCC source to pin 14 of a dual timer 337, such as an NE556. One side of the timer includes a 390k ohm resistor 338 in combination with a 0.47 and 0.01 microfarad capacitor to provide a short duration time constant. When the phototransistor receives a predetermined amount of light, an output signal from pin 9 through a resistor 340 fires a C106D1 silicon controlled rectifier 342. The SCR 342 energizes the solenoid 200 for a short period of time which actuates the target impellers. The solenoid 200 is immediately de-energized to permit the actuator 202 to return to its downward position.

The opposite side of the IC337 includes a 2.2 megaohm resistor 350 which provides approximately a five second output on pin 5 which, through a similar resistor 352, fires a second SCR 356. The SCR 356 illuminates the hit indicating lights 164 and 194 for the five second interval. An additional solenoid 358 connected in parallel with the lights 164 and 194 actuates a sounding means, generally designated 360 (FIG. 2). The solenoid 358 is mounted on the front wall so that its armature 362 contacts and rings a bell 364 when actuated.

In addition, at the top of FIG. 9, the score illuminator light 300 is shown as always being energized when the 18v power is supplied. Preferably, the 18v power supply is provided from a voltage reduction transformer suitable for use with any 110v AC outlet.

Figure 10:
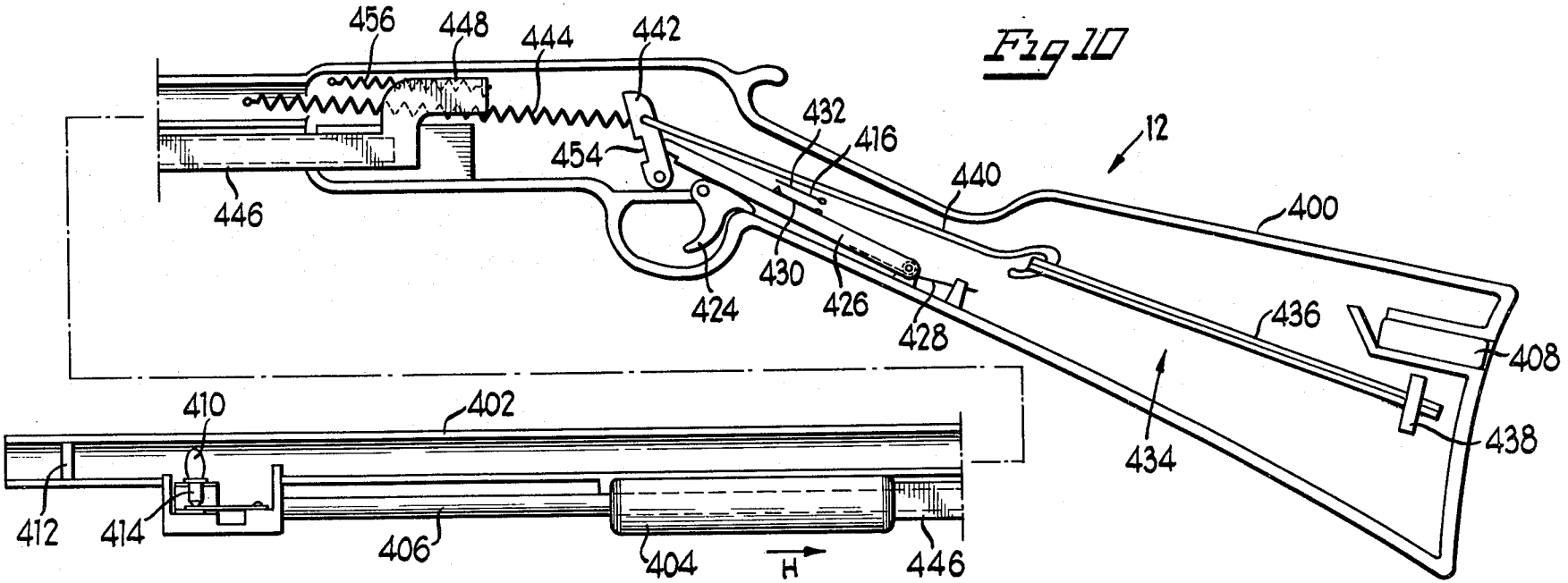
FIG. 10 is a vertical section of the simulated gun of FIG. 1.
Figure 11:
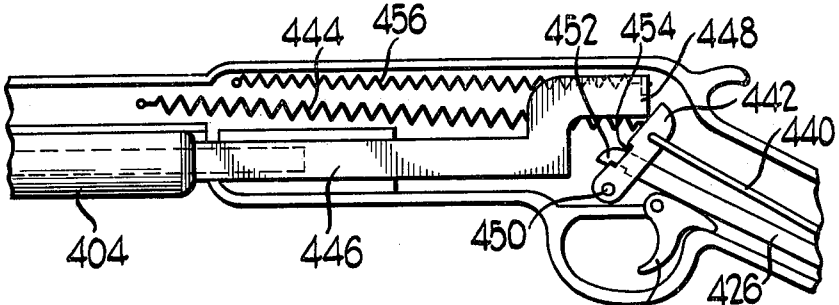
FIG. 11 is a partially fragmented, vertical section of the simulated gun, showing the elements in their cocked position.
Figure 12:
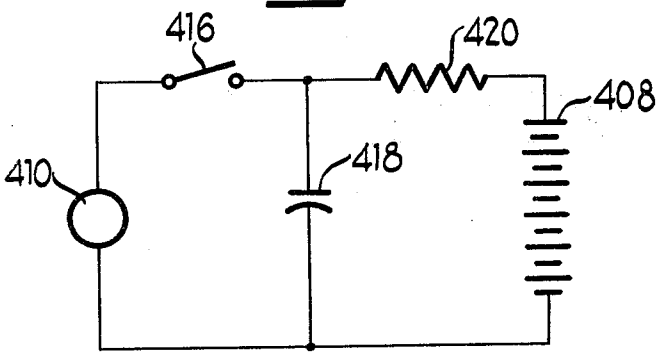
FIG. 12 is an electrical schematic view of the capacitor discharge circuit of the simulated gun of FIG. 10.

Turning now to FIGS. 10–12, the aiming device or simulated gun 12 provides the predetermined amount of light necessary for firing one of the phototransistors 233L, 233R or 252. The gun 12 includes a simulated, molded, generally hollow butt portion 400 and a forwardly extending barrel 402. A pumping or cocking handle 404 is mounted for reciprocal movement by a shaft 406 below the barrel 402. A battery 408 is mounted within the butt for connection with a lightbulb 410 mounted behind a lens 412 in the barrel. The lightbulb 410 is connected through its base 414 to the battery 408 as shown in FIG. 12. A trigger switch 416 connected the bulb 410 in parallel with a capacitor 418 which is charged by the battery 408 through a resistor 420 when the switch 416 is open. When the switch 416 is momentarily closed, the capacitor discharges through the bulb 410 to provide a short flash of light which is focused by the lens 412 to impinge one of the photodetectors directly below the target.

The simulated gun includes a pivotally mounted trigger 424 engaging a follower 426 which is biased by a spring 428 downwardly against the trigger. The switch 416 includes one contact 430 mounted on the follower 426 and a second leaf or contact 432 mounted on the interior of the butt so that pivotal movement of the trigger causes the follower 426 to pivot upwardly against the biasing force to make the contact and thus discharge the capacitor 418.

To provide a more realistic effect for the simulated gun, a recoil, sounding means generally designated 434 is mounted within the butt. The recoil sounding means 434 comprises a pair of plastic straps 436 secured by a flange 438 at the rearward end of the butt. The opposite end of the plastic straps 436 are connected to a tie rod 440 which is pivotally mounted to a clamp arm 442 formed from a channel. The clamp arm 442 is biased forwardly by a spring 444 which maintains tension on the straps 436. The cocking handle 404 includes a rearwardly extending actuator 446 which extends into the forward end of the butt 400 and includes a dog leg portion 448. The dog leg portion 448 engages the clamp 442 as the pump handle 404 is moved rearwardly in the direction of arrow H.

Referring to FIG. 11, the dog leg portion 448 pivots the clamp 442 rearwardly about a pivotal axis 450. The clamp includes an aperture generally in the center flange thereof which permits the forward end of the follower 426 to pass therethrough during cocking. The forward end 452 includes a notch which engages a similar notch 454 on the clamp 442 due to the influence of the biasing spring 428. The engagement of the respective notches maintains the clamp in its position as shown in FIG. 11 and release of the pump handle 404 permits the handle to move in the direction opposite that of arrow H under the influence of a spring 456. The rearward pivotal movement of the clamp 442 drives the tie rod 440 rearwardly to cause the plastic strips 436 to bow away from one another, and they are maintained in that position by the clamp notch. When the trigger 424 is actuated, the follower 426 is raised, as described previously to make the switch 416, the clamp 442 pivots forwardly under the influence of the spring 444 causing the flexible plastic straps 434 to slap against one another providing a realistic firing sound and recoiling feeling for the user. In addition, since the contact 416 has been made, a substantially simultaneous flash of light is projected toward the photo-transistors as the capacitor 418 discharges. It should be pointed out that, although the cocking mechanism has been designed to provide a realistic effect, the simulated gun 12 can be used and provides repeated light bursts to emanate toward the target apparatus 10 without cocking the gun each time since the contacts 416 will be made each time the trigger is pulled regardless of the condition of the cocking mechanism.

The foregoing detailed description has been given for clearness of understanding only and no unnecessary limitations should be understood therefrom as some modifications will be obvious to those skilled in the art.

We claim:

1. A target apparatus, comprising:

a frame;

a plurality of target devices movably mounted on the frame;

a plurality of target impeller means operatively associated with said target devices for moving at least one of the target devices upon actuation thereof;

means for providing light of a predetermined intensity;

circuit means including at least one photodetector remotely disposed from said target devices for providing an output signal upon the sensing of light of a predetermined intensity; and an actuator operatively associated between said circuit means and said target impeller means for actuation of said impeller means in response to the output signal from said circuit means as actuated by said light striking one of the photodetectors, said actuator including a single solenoid connected to said circuit means and linkage means between said solenoid and said plurality of target impeller means whereby all of the target impeller means are actuated in response to the output signal actuating said solenoid.

2. The target apparatus of claim 1 wherein said linkage means includes three pivotally mounted arms, one of which is slidably mounted for reciprocatory movement, each of said arms being connected to one of said plurality of target impeller means, and flexible actuator connector means for engagement with said slidably mounted arm.

3. The target apparatus of claim 1 wherein said target devices each include a leg portion for engagement with said target impeller means to cause the targets to be moved upon actuation of the impeller means.

4. The target apparatus of claim 1 wherein each of said targets is pivotally mounted for movement between a generally vertical, preset position to a generally horizontal, hit position.

5. The target apparatus of claim 1 including a plurality of lights and a timer connected to said circuit means for energizing said lights for a predetermined period of time upon actuation of said target impeller actuator.

6. The target apparatus of claim 1 including sounding means for providing an audible signal in response to the output signal of said circuit means.

7. The target apparatus of claim 1 including a plurality of target mounting subframes, each of said targets being mounted to one of said subframes and drive means for continuously moving said subframes during the play of the game.

8. The target apparatus of claim 1 wherein said means for providing light or a predetermined intensity comprises a selectively operable aiming device for directing a beam of light toward a photodetector.

9. The target apparatus of claim 8 wherein said aiming device includes sounding means providing an audible signal upon selective operation thereof.

10. The target apparatus of claim 9 wherein said sounding means comprises a pair of flexible bands, said bands being movable from a bowed, separated position to a contact position upon operation of said aiming device.

11. A target apparatus, comprising:

a frame;

a plurality of movable target mounting subframe assemblies, wherein each target mounting subframe assembly is a rotatable platen;

a plurality of sets of target devices, each set of said target devices, including more than one target device, and each set being mounted on said target mounting subframe assemblies movably mounting the target on the frame, each target device being pivotally mounted to one of said subframe assemblies;

drive means for continuously moving said target mounting subframe assemblies relative to said frame;

a plurality of target impeller means mounted on the frame and operatively associated with said target devices for moving at least one of the target devices upon actuation thereof;

means for providing light of a predetermined intensity;

circuit means including a plurality of photodetectors remotely disposed from said target devices for providing an output signal upon the sensing of light of a predetermined intensity; and an actuator operatively associated between said circuit means and said target impeller means for actuation of the impeller means in response to the output signal from said circuit means as actuated by said light striking one of the photodetectors.

12. The target apparatus of claim 11 wherein each of said target devices mounted on said rotatable platens includes a leg member extending past the periphery of said rotatable platen for engagement by the target impeller means to cause the target to rotate about its pivotal axis when the target impeller means is actuated.

13. The target apparatus of claim 12 wherein said platens are drivingly connected in an out-of-phase relationship to permit engagement of the target leg members of target devices on only one of said platens at a particular instant in time.

14. The target apparatus of claim 13 wherein said activator includes a single solenoid, energized by said circuit means, for actuating said target impeller means.

15. A target apparatus, comprising:

a frame;

a plurality of movable target mounting subframe assemblies, wherein each subframe assembly is a rotatable platen;

a plurality of sets of target devices, each set of said target devices, including a plurality of target devices, and each set being mounted to a movable subframe assembly for movably mounting the target devices on the frame;

drive means for continuously moving said target mounting subframe assemblies relative to said frame;

means for providing light of a predetermined intensity;

a plurality of photodetectors, one for each subframe assembly, operatively associated with said target devices and remotely mounted therefrom for receiving light from said light means;

circuit means including a parallel connection between said photodetectors for providing an output signal upon the sensing of light of a predetermined intensity by any one of said photodetectors; and scoring means operatively connected to said circuit means for providing an incremental score in response to the output signal from said circuit means as actuated by said light striking one of the photodetectors.

16. The target apparatus of claim 15 including timing means for disabling the drive means after a predetermined period of time.

17. The target apparatus of claim 15 including a plurality of lights and a timer connected thereto for energizing said lights for a predetermined period of time upon actuation of said scoring means.

18. The target apparatus of claim 15 including a single solenoid connected to said circuit means for operation of said scoring means upon energization thereof.

19. The target apparatus of claim 15 wherein said means for providing light comprises a selectively operable aiming device including a light source therein for directing a beam of light toward one of said photodetectors when the aiming device is properly aimed toward the respective target.

20. The target apparatus of claim 19 wherein said aiming device includes sounding means providing an audible signal upon selective operation thereof.

21. The target apparatus of claim 20 wherein said sounding means comprises a pair of flexible bands, said bands being movable from a bowed, separated position to a contact position upon operation of said aiming device.

22. A target apparatus, comprising:

a frame;

a plurality of pivotally mounted target devices, each of said target devices including a subframe assembly for mounting the target device on the frame;

drive means for continuously moving said target mounting subframe assemblies relative to said frame;

a plurality of target impeller means operatively associated with said target devices for moving at least one of said target devices upon actuation thereof;

means for providing light of a predetermined intensity;

circuit means for providing an output signal upon the sensing of light of a predetermined intensity, said circuit means including a plurality of photodetectors, a single solenoid connected to said circuit means such that said output signal from said circuit means energizes said solenoid, an actuator operatively associated between said solenoid and said target impeller means such that said plurality of impeller means are actuated when said solenoid is energized.

* * * * *